US008079883B2

(12) United States Patent
Pascut

(10) Patent No.: US 8,079,883 B2
(45) Date of Patent: Dec. 20, 2011

(54) CONTROLLER FOR A MOTOR VEHICLE

(75) Inventor: Marius Pascut, Vienna (AT)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 12/529,408

(22) PCT Filed: Jan. 24, 2008

(86) PCT No.: PCT/EP2008/050802

§ 371 (c)(1),
(2), (4) Date: Jan. 5, 2010

(87) PCT Pub. No.: WO2008/104425

PCT Pub. Date: Sep. 4, 2008

(65) Prior Publication Data

US 2010/0151708 A1 Jun. 17, 2010

(30) Foreign Application Priority Data

Mar. 1, 2007 (DE) ..... 10 2007 010 009

(51) Int. Cl.
*H01R 13/514* (2006.01)

(52) U.S. Cl. ..... 439/752; 439/76.2

(58) Field of Classification Search ..... 439/76.2, 439/752

See application file for complete search history.

(56) References Cited

U.S. PATENT DOCUMENTS 5,364,280 A 11/1994 Colleran
6,042,392 A * 3/2000 Tsuji ..... 439/76.1
6,107,713 A 8/2000 Hülsmann et al.
6,454,604 B1 9/2002 Currie et al.
6,994,598 B2 * 2/2006 Holmes et al. ..... 439/752.5
7,033,186 B2 * 4/2006 Kawakita et al. ..... 439/76.2
7,120,024 B2 * 10/2006 Watanabe et al. ..... 361/704
7,520,759 B2 * 4/2009 Seff et al. ..... 439/76.2

FOREIGN PATENT DOCUMENTS

DE 4221137 A1 1/1994
DE 19839333 C1 1/2000
WO WO99/54973 10/1999
WO WO2004/008588 1/2004

OTHER PUBLICATIONS

International Search Report, PCT/EP2008/050802, 11 pages, Apr. 21, 2008.

* cited by examiner

*Primary Examiner* — Truc Nguyen

(74) *Attorney, Agent, or Firm* — King & Spalding L.L.P.

(57) ABSTRACT

A controller for a motor vehicle has a housing, which has an upper housing part made of non-conductive material and a lower housing part, a printed circuit board disposed in the housing, the board bearing an electric circuit, which can be connected by contact elements of a plug connector disposed in the region of a housing passage, with each contact element being configured as one piece from a first contact section, which is disposed on the inside of the housing and connected at the end to the printed circuit board, and a second contact section, which extends substantially parallel to the printed circuit board and is guided through the housing passage, wherein in the housing passage a contact support device is provided, by which each of the second contact sections is supported on the upper housing part or on the lower housing part.

20 Claims, 5 Drawing Sheets

FIG 1
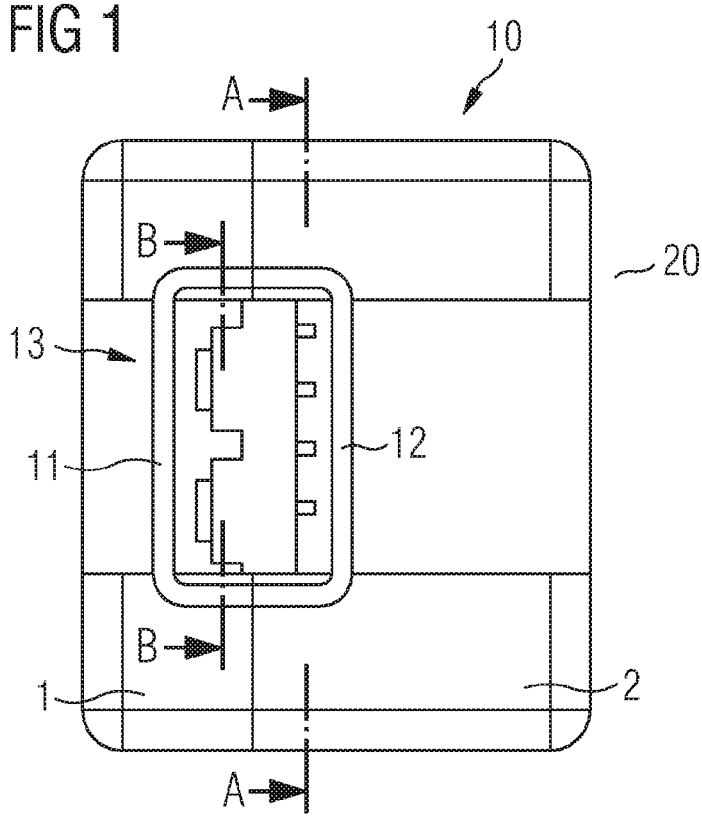
FIG 2 SCHNITT B-B
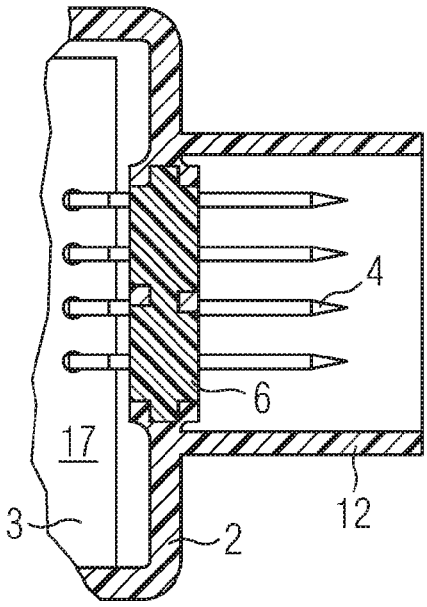
FIG 3 SCHNITT A-A
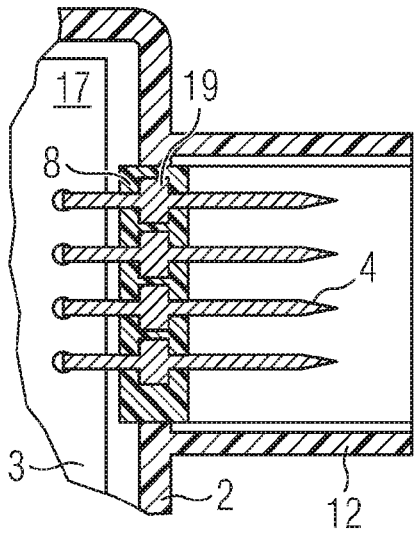

FIG 6
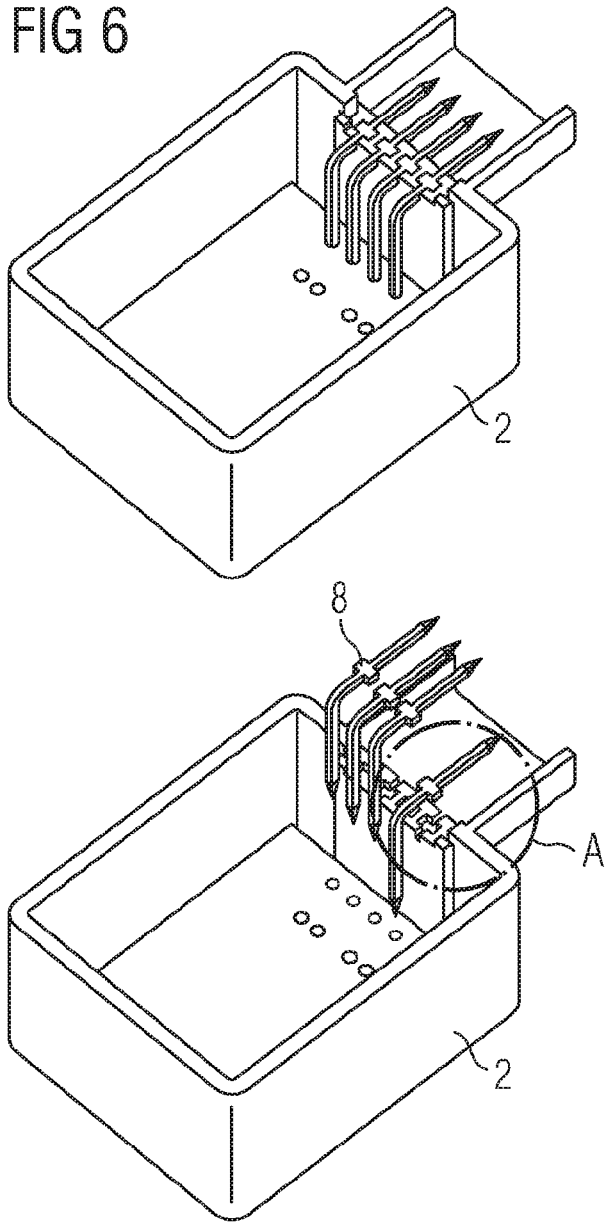
DETAIL A
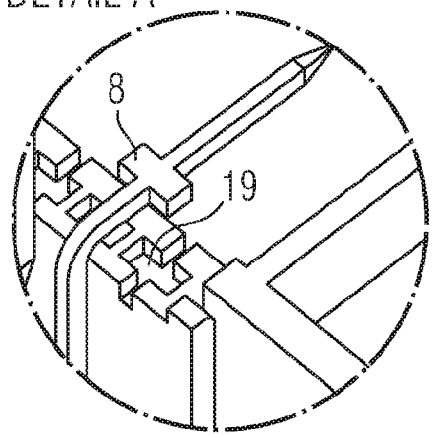

CONTROLLER FOR A MOTOR VEHICLE

CROSS-REFERENCE TO RELATED APPLICATIONS

This application is a U.S. National Stage Application of International Application No. PCT/EP2008/050802 filed Jan. 24, 2008, which designates the United States of America, and claims priority to German Application No. 10 2007 010 009.6 filed Mar. 1, 2007, the contents of which are hereby incorporated by reference in their entirety.

TECHNICAL FIELD

The invention relates to a controller for a motor vehicle comprising a housing made of non-conductive material consisting of an upper housing part and a lower housing part. A printed circuit board disposed in the housing, which bears an electric circuit, can be connected by means of contact elements of a plug connector disposed in the region of a housing passage. Each contact element of the plug connector is configured as one piece and consists of a first contact section, and a second contact section. The first contact sections are connected at the end to the printed circuit board and are arranged on the inside of the housing. The second contact sections extend substantially parallel to the printed circuit board and are guided through the housing passage.

BACKGROUND

Controllers are used in motor vehicles for drive apparatuses for instance, as are known for instance from DE 198 39 333 C1 in order to adjust windows, seats or wipers or other actuators in a positionally-accurate fashion.

DE 42 21 137 A1 describes such a controller with a two piece housing for instance, in which the electrical connection takes place by means of angled contact elements of a plug connector consisting of several parts. The contact elements of the plug connector are embedded in a plug body, which is held in the passage of the housing by means of a locking connection. The plug body functions on the one hand as a support or bracket for the contact elements and on the other hand receives the vibrational forces transmitted by way of the connected cable during operation of the motor vehicle, so that these forces are only transmitted to the electrical connection between the printed circuit board and plug contact in attenuated form.

Motor vehicle controllers are also known, in which the plug connector is inserted into a housing recess as a separate component and the plug body is screwed or riveted to the printed circuit board.

One significant disadvantage of these known connecting constructions is that they always consist of several parts, thereby rendering the production, storage and assembly complicated. A plug apparatus as a separate supply component is expensive. If the seal of the housing is only embodied to be splash water- and/or dust-tight, the many sealing points are unfavorable.

SUMMARY

According to various embodiments, a controller can be specified which can be produced at low cost.

According to an embodiment, a controller for a motor vehicle may comprise a housing, which has an upper housing part and lower housing part formed from a non-conductive material in each instance, a printed circuit board arranged in the housing, which bears an electrical circuit, which can be contacted by means of contact elements of a plug connector arranged in the region of a housing passage, with each contact element being formed in one piece from a first connect section arranged on the inside of the housing and connected at the end of the printed circuit board and a second contact section which extends substantially in parallel to the printed circuit board, which is guided through the housing passage, Wherein a form-fit contact support structure is embodied in the housing passage, with which each of the two contact sections is supported against the upper housing part or the lower housing part.

According to a further embodiment, the second contact sections can be arranged in a first contact plane and in a second contact plane, with the contact sections arranged in the first contact plane and the contact sections arranged in the second contact plane being supported against the lower housing part and the upper housing part respectively by means of the contact support structure and with a cover element being provided between the first and the second contact plane. According to a further embodiment, the cover element can be embodied as a plate-like cover part, which is connected to the upper housing part and/or the lower housing part by means of a form-fit connection. According to a further embodiment, the form-fit connection can be embodied as a locking connection. According to a further embodiment, the contact support structure can be formed by a form pairing of an attachment embodied on the contact element and an assigned congruent recess, which is embodied on the upper housing part and/or on the lower housing part. According to a further embodiment, the attachment can be formed by a cross-sectional extension embodied on the second contact section. According to a further embodiment, the first contact sections can be embodied at the end as press-fit pins, which are arranged to be free-standing on the printed circuit board and are pressed into metalized printed circuit board holes. According to a further embodiment, the plug connector may have a first and a second collar part, with the first collar part being embodied in one piece with the upper housing part and the second collar part being embodied in one piece with the lower housing part. According to a further embodiment, the upper housing part and the lower housing part can be manufactured from a polymer material by means of injection molding. According to a further embodiment, the second contact sections can be arranged in parallel adjacent to one another.

BRIEF DESCRIPTION OF THE DRAWINGS

To further explain the invention, reference is made in the subsequent part of the description to the drawings, from which additional advantageous embodiments, details and developments of the invention can be inferred, in which;

FIG. 1 shows a side view of the controller with the intersecting lines A-A and B-B;

FIG. 2 shows an enlarged partial section according to the intersecting lines B-B in FIG. 1;

FIG. 3 shows an enlarged partial section according to the intersecting lines A-A in FIG. 1;

FIG. 6 shows a spatial representation of the controller, in which the upper housing part is removed with an enlarged representation of detail A;

DETAILED DESCRIPTION

Figure 4:
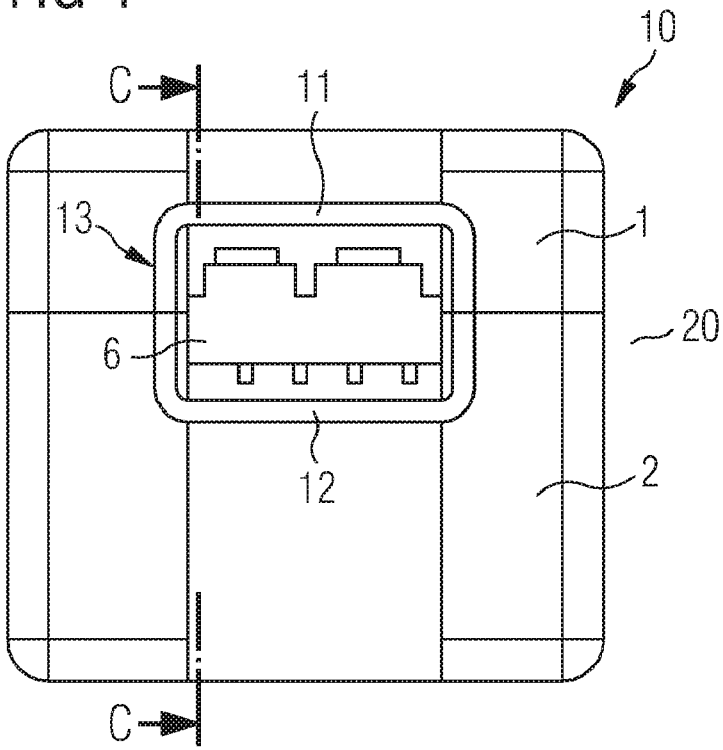
FIG. 4 shows a side view of the controller with a view of the plug connector in which the intersecting line C-C is shown.

According to various embodiments, a contact support structure is provided in the housing passage, with which each of the implemented contact sections is supported against the upper housing part or the lower housing part. The support takes place by means of a form fit and/or form pairing between a contact element profile and a congruent profile in the contact feed through. This housing support allows the tensile and compressive forces, which act on the plug elements as a result of vibrations and/or connection of the cable fed in from the outside, to be intercepted by the housing itself. An avoidance of the angled contact elements is not possible. As a result, the electrical connection between each of the contact elements and the assigned conductor path on the printed circuit board is strained less significantly. This improves the reliability of the controller. A special supporting body for holding the contact elements is dispensed with since the board functions as a contact element bracket. Since the construction according to various embodiments consists of fewer individual parts, manufacture is more favorable. Due to the integration of the support function into the housing, sealing is simpler since it is not only the expensive supplier that is left out but instead also the sealing joint.

According to one embodiment, the fed through contact sections are arranged in a first contact plane and in a second contact plane, with the contact sections arranged in the first contact plane and the contact sections arranged in the second contact plane being supported against the lower housing part and the upper housing part respectively by means of the contact support structure, and with a cover element being provided between the first and the second contact plane. The mechanical decoupling of the forces acting on the electrical connection with the printed circuit board is thus assumed in accordance with various embodiments by one of the housing shells. The cover element between the rows of contacts can be embodied as a sealing mass or as a rigid body.

The cover element can favorably be manufactured as a plate-like cover part, which is connected to the upper housing part and/or the lower housing part by means of a form-fit connection.

The contact support structure can advantageously be embodied by a form pairing of an attachment embodied on the contact element in conjunction with an assigned congruent recess on the upper housing part and/or on the lower housing part. The attachment may be an offset, a notch, a bending punching in a blade-like contact element for instance.

The attachment can be formed in a manufacturing specific fashion by a cross-sectional extension embodied on the fed-through contact section.

According to a further embodiment, contact sections arranged inside of the housing are embodied as press-in pins, which are arranged to be free standing on the printed circuit board. The free standing arrangement of the contact elements produces the afore-cited advantages such that the contact support or supporting element which was previously needed to hold the contacts is not needed for the contact elements. The printed circuit board itself forms a support for the contact pins without a special supporting component being needed. The contact pins can be operated particularly well by means of contact placement machines and can be easily integrated into the assembly procedure of a production plant for equipping the electronic circuit. Compared with a solder connection, the press fit technology is more cost-effective than solder-free connection technology and is very well suited to automatic production. Pressing the pin edges of a contact element into a metalized hole produces a gas-tight electrical connection which is characterized in terms of high reliability and longevity.

In one embodiment, provision can be made for the plug connector to have a first and a second collar part, with the first collar part being embodied in one piece with the upper housing part and the second collar part being embodied in one piece with the lower housing part. This allows the connector collar to be integrated in the upper housing part and/or lower part. The housing and plug connector are manufactured particularly easily and in a cost-effective fashion since it takes place in one work step. Each of these half shells can be produced in an injection molding process. A mechanical coding for the plug to be connected can be embodied in each collar part. Each collar part protects the contact elements and may contain a sealing element.

The manufacture of both half shells can take place in a particularly favorable fashion in large amounts by means of injection molding a polymer material.

FIG. 1 and FIG. 4 each show a side view of an exemplary embodiment of the controller 10, which is designed for an electromotive window lift in the door of a motor vehicle.

Figure 5:
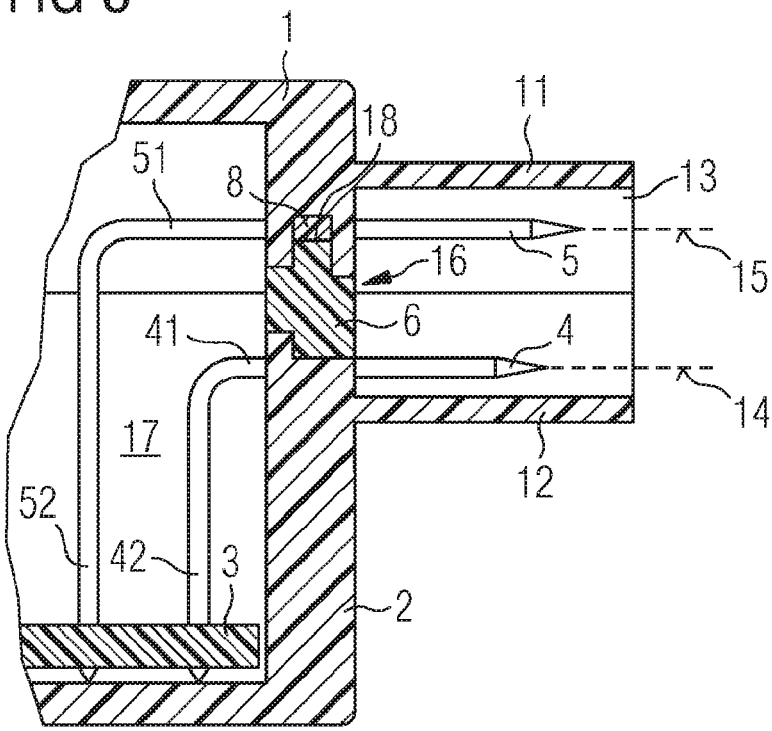
FIG. 5 shows an enlarged partial section according to the intersecting lines C-C in FIG. 4.

FIG. 2, FIG. 3 and FIG. 5 each show an enlarged partial section according to the intersecting lines in FIG. 1 and/or FIG. 4.

As can be inferred best from FIG. 5, the housing 20 is made of an upper housing part 1 and a lower housing part 2. The housing parts 1, 2 are embodied like a tray and manufactured from plastic. In the region of a housing passage 16 of a side wall of the housing 20, contact elements 4, 5 are lead through a shaft of a plug connector 13 which is formed by a plug collar 12, 11. The plug connector 13 is not a separate part, but is instead integrated into the housing 20 in accordance with various embodiments. The contact elements 4, 5 consist in each instance of a row of contact pins and a row of blade contacts. Each of the contact elements 4 and/or 5 consists of one part. Each part is composed of a first contact section 42, 52 and a second contact section 41, 51, which draw an angle of 90 degrees. The first contact sections 42, 52 are arranged to be free standing on the printed circuit board 3.

Contrary to the previously known prior art, no supporting element exists. Its end pieces adjacent to the printed circuit board 3 are each pressed into metalized holes of the printed circuit board by means of press fit technology. The second contact sections 41, 51 are arranged in the shaft of the plug connector 13 in a first contact plane 14 and/or in a second contact plane 15. They are each adjacent to another and parallel to the plane of the printed circuit board. As clearly apparent from the sectional drawing in FIG. 5, the vertical second contact section 51 rests in a form-fit fashion in a congruent recess 18 in the upper housing part 1 by means of the profile or attachment 8. The corresponding form pairing also allows for the support of the vertical contact sections 41 arranged in the first contact plane 14, which is best seen from the sectional representation in FIG. 3 and/or from the enlarged representation of detail A in FIG. 6, in which the attachment 8 comes to rest in the recess 19.

The plug collar of the plug connector 13 is formed by a first collar part 11 and a second collar part 12, which are each molded in one piece and from the same material (plastic) to the upper housing part 1 and/or the lower housing part 2.

The housing parts 1, 2 are held together in a combined state by means of locking connections (not shown). The board 3 is held by brackets (not shown) in the interior 17 of the housing 20. The controller 10 shown in FIGS. 1 to 6 can naturally contain several printed circuit boards. Several of the aforecited plug facilities can likewise be provided on the housing 20.

Figure 7:
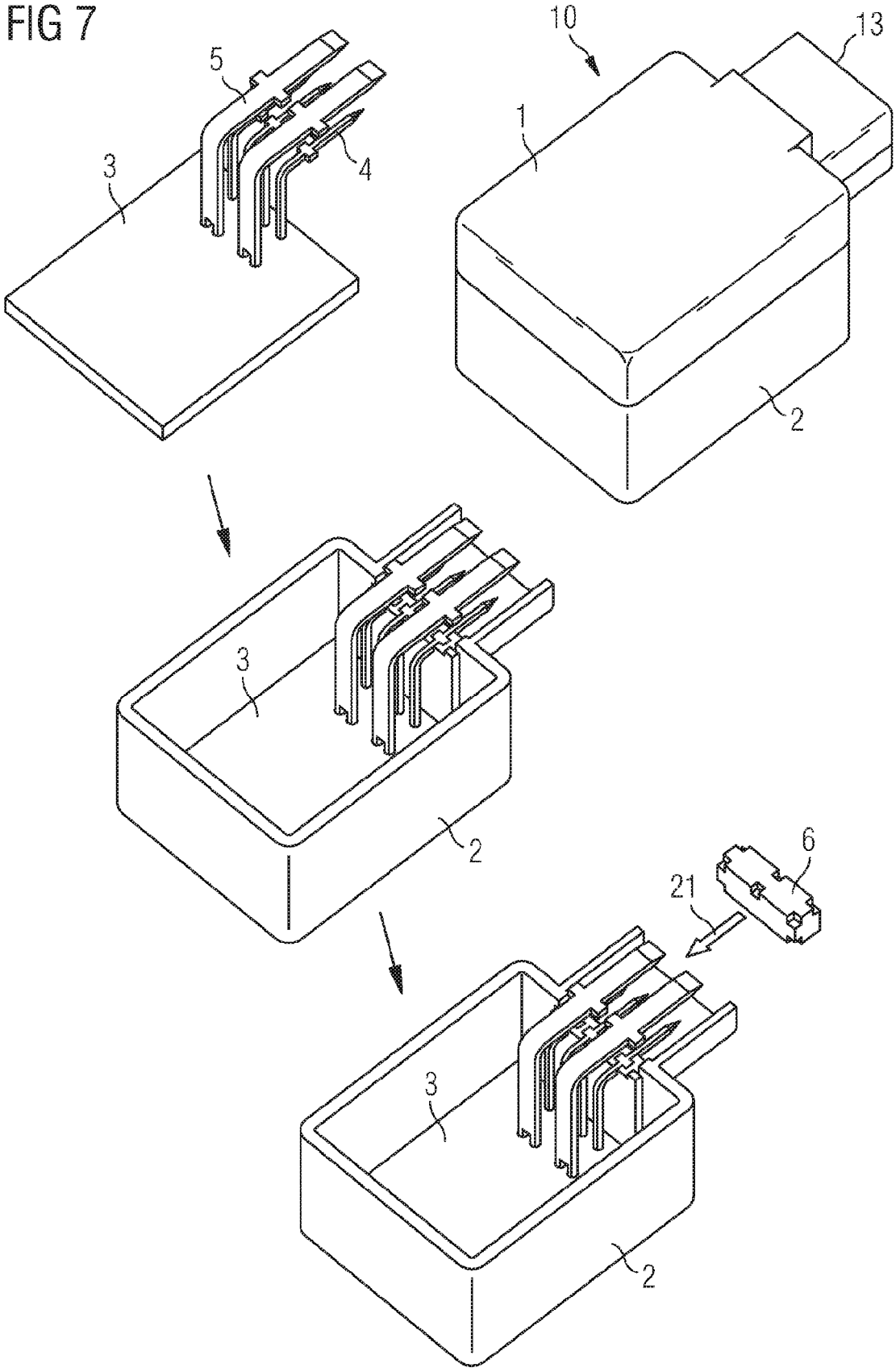
FIG. 7 shows a schematic representation of the assembly of a first embodiment variant.
Figure 8:
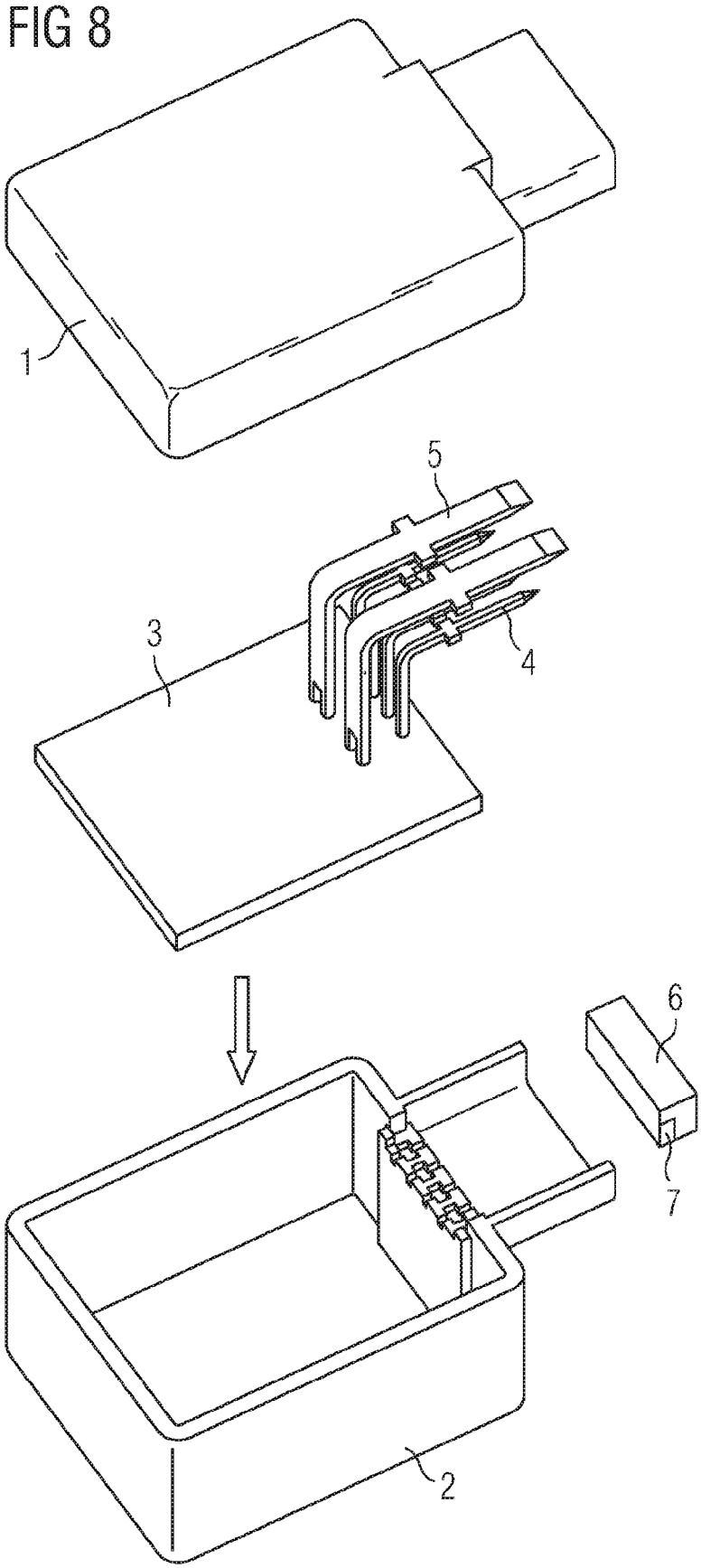
FIG. 8 shows a schematic representation of the assembly of the individual components of a second embodiment variant.

FIGS. 7 and 8 show the sequence of production steps. FIG. 7 shows the assembly step for a first variant of the exemplary embodiment and FIG. 8, the one second variant. In both variants the contact elements 4, 15 are pressed into press-fit holes in a freestanding fashion in a preassembled stage without supporting elements on the printed circuit board 3.

First Variant:

In a first assembly step, the printed circuit board 3 plus the free-standing, angled contact elements 4, 5 which are preassembled using press-fit technology onto the printed circuit board 3 are lowered into the lower housing part 2 and are received by a recess (not shown in further detail). Each attachment 8 comes to rest in a congruent recess 19.

In a second step, the plate-like cover element 6 is inserted between the two contact planes 14, 15 in the plug direction 21 and is held by clamping. The upper housing part is attached in a third step, as a result of which it is held by a form-fit between the housing parts 1, 2.

Second Variant:

In a first assembly step, the printed circuit board plus the preassembled contact elements 4, 5 is lowered into the lower housing shell 2 which opens upwards.

In a second step, the upper housing part 1 is attached and locked.

In a third step, the cover element 6 is inserted in the plug direction 21 by engaging the locking connection 7 into the housing passage 16.

COMPILATION OF THE REFERENCE CHARACTERS USED

1. upper housing part
2. lower housing part
3. printed circuit board
4. contact elements of the first contact plane
5. contact elements of the second contact plane
6. Cover element
7. locking connection
8. attachment, profile
9. form fit between 6 and 2.1
10. controller
11. first collar part
12. second collar part
13. plug connector
14. first contact plane
15. second contact plane
16. housing passage
17. interior
18. recess
19. recess
20. housing
21. plug-in direction
41, 51 second contact sections
42, 52 first contact sections

What is claimed is:

1. A controller for a motor vehicle, comprising a housing, which has an upper housing part and lower housing part each formed from a non-conductive material and a housing passage formed by said upper and lower housing parts, a printed circuit board arranged in the housing, which comprises an electrical circuit, which can be contacted by means of contact elements of a plug connector arranged in the region of the housing passage, wherein each contact element is formed in one piece from a first connect section arranged on the inside of the housing and connected at the end of the printed circuit board and a second contact section which extends substantially in parallel to the printed circuit board, which is guided through the housing passage, wherein a form-fit contact support structure is embodied in the housing passage, with which at least the second contact sections are supported against the upper housing part or the lower housing part.

2. The controller according to claim 1, wherein the contact elements comprise first and second contact elements and the second contact sections of the first contact elements are arranged in a first contact plane and the second contact sections of the second contact elements are arranged in a second contact plane, with the second contact sections of the first contact elements being supported against the lower housing part and the second contact sections of the second contact elements being supported against the upper housing part by means of the contact support structure and with a cover element being provided between the first and the second contact plane.

3. The controller according to claim 2, wherein the cover element is embodied as a plate-like cover part, which is connected to at least one of the upper housing part and the lower housing part by means of a form-fit connection.

4. The controller according to claim 3, wherein the form-fit connection is embodied as a locking connection.

5. The controller according to claim 3, wherein the contact support structure is formed by a form pairing of an attachment embodied on the contact element and an assigned congruent recess, which is embodied on at least one of the upper housing part and on the lower housing part.

6. The controller according to claim 5, wherein the attachment is formed by a cross-sectional extension embodied on the second contact section.

7. The controller according to claim 1, wherein the first contact sections are embodied at the end as press-fit pins, which are arranged to be free-standing on the printed circuit board and are pressed into metalized printed circuit board holes.

8. The controller according to claim 1, wherein the plug connector has a first and a second collar part, with the first collar part being embodied in one piece with the upper housing part and the second collar part being embodied in one piece with the lower housing part.

9. The controller according to claim 8, wherein the upper housing part and the lower housing part are manufactured from a polymer material by means of injection molding.

10. The controller according to claim 8, wherein the second contact sections are arranged in parallel adjacent to one another.

11. A method for manufacturing a controller for a motor vehicle, comprising the steps of:

providing a housing from an upper housing part and lower housing part each being formed from a non-conductive material, wherein a housing passage is formed by said upper and lower housing, parts, arranging a printed circuit board in the housing, which comprises an electrical circuit, which can be contacted by means of contact elements of a plug connector arranged in the region of the housing passage, wherein each contact element is formed in one piece from a first connect section arranged on the inside of the housing and connected at the end of the printed circuit board and a second contact section which extends substantially in parallel to the printed circuit board, which is guided through the housing passage, and embodying a form-fit contact support structure in the housing passage, with which at least the second contact sections are supported against the upper housing part or the lower housing part.

12. The method according to claim 11, further comprising the step of providing first and second contact elements and arranging the second contact sections of the first contact elements in a first contact plane and the second contact sections of the second contact elements in a second contact plane, wherein the second contact sections of the first contact elements being supported against the lower housing part and the second contact sections of the second contact elements being supported against the upper housing part by means of the contact support structure and wherein a cover element is provided between the first and the second contact plane.

13. The method according to claim 12, wherein the cover element is embodied as a plate-like cover part, which is connected to at least one of the upper housing part and the lower housing part by means of a form-fit connection.

14. The method according to claim 13, wherein the form-fit connection is embodied as a locking connection.

15. The method according to claim 13, wherein the contact support structure is formed by a form pairing of an attachment embodied on the contact element and an assigned congruent recess, which is embodied on at least one of the upper housing part and on the lower housing part.

16. The method according to claim 15, wherein the attachment is formed by a cross-sectional extension embodied on the second contact section.

17. The method according to claim 11, wherein the first contact sections are embodied at the end as press-fit pins, which are arranged to be free-standing on the printed circuit board and are pressed into metalized printed circuit board holes.

18. The method according to claim 11, wherein the plug connector has a first and a second collar part, with the first collar part being embodied in one piece with the upper housing part and the second collar part being embodied in one piece with the lower housing part.

19. The method according to claim 18, wherein the upper housing part and the lower housing part are manufactured from a polymer material by means of injection molding.

20. The method according to claim 18, wherein the second contact sections are arranged in parallel adjacent to one another.

* * * * *